US005634710A

United States Patent [19]

Di Russo et al.

[11] Patent Number: 5,634,710

[45] Date of Patent: Jun. 3, 1997

[54] KEYHOLE LIGHT

[76] Inventors: David Di Russo, 1304 Elgin St., San Leandro, Calif. 94578; Kenneth Tarlow, 94 Birch Ave., Corte Madera, Calif. 94925

[21] Appl. No.: 683,086

[22] Filed: Jul. 18, 1996

[51] Int. Cl.[6] ..... E05B 17/10

[52] U.S. Cl. ..... 362/100; 362/84; 362/394

[58] Field of Search ..... 362/84, 80, 100, 362/394, 802

[56] References Cited

U.S. PATENT DOCUMENTS 4,234,909 11/1980 Cotroneo ..... 362/100

4,293,894 10/1981 Blank ..... 362/100

*Primary Examiner*—Stephen F. Husar

[57] ABSTRACT

An improved key hole light which can be easily added to an existing door lock or ignition switch whose illuminating element is an electroluminescent panel which is die cut into a flat doughnut shaped pattern. The inside of the pattern is the size of a standard key hole area of about one half of one inch and the outside diameter of the panel is about one inch. A two inch long tail portion is integral with the doughnut shape which allows the flexible light display to be bent and adhered to the contours of a lock assembly or door knob assembly. An extendible pair of coated wires attach the light display to an electronic module which contains a power supply, a timer circuit and a high voltage transformer. A conductive switch panel is connected by two wires to the electronic module. When a person touches his or her finger to any portion of the conductive switch panel it causes the light display to illuminate for approximately ten seconds and then automatically turn off.

3 Claims, 4 Drawing Sheets

KEYHOLE LIGHT

BACKGROUND OF INVENTION

The present invention relates to electric lighting devices and more specifically to a battery operated electroluminescent light designed to illuminate a keyhole during night time or similar darkened conditions. Frequently at night people find themselves in the position of searching for a keyhole to a house or apartment door lock or to the ignition switch in a vehicle. The darkened conditions force a person to blindly search hoping that the key will find the small slot in the associated keyhole.

Numerous products have been introduced over the years to attempt to remedy this problem. These include lights that are mounted directly above the keyhole, motion sensor lights that light up an entire front door area and lights that are built into a locking mechanism or doorknob. However, there are some short comings to each method proposed to date. Lights that are mounted directly over a keyhole or door knob often fail to properly light the key hole slot because the locking mechanism is protruding beyond the flat surface of the door. This is especially true when the keyhole is located in the center of a door knob. In these cases the light emanating from a downwardly pointing door mounted light source fails to project out far enough to properly light a raised lock or door knob face. Lights built into key hole locking mechanisms can be effective however the user is required to replace the existing non lighted lock which can be a time consuming and costly activity. Lights which light up an entire door way area consume a lot of electricity and may be disturbing to neighbors. Finally, with regard to lighting up the ignition switch area of a car or truck, some cars and trucks have built in lights which turn on temporarily to help the driver find the key hole however there is no remedy for those car and truck owners who do not have this feature built into their vehicles. They must continue to search in the dark for the elusive key hole.

SUMMARY OF THE PRESENT INVENTION

It is an object of the present invention to provide an improved key hole light wherein the light encircles and targets the key hole no matter how far away from the door the key hole is. Another object of the present invention is to provide an improved key hole light wherein the user can touch anywhere on a relatively large metallic conductive surface area switch to turn the light on. Another object of the present invention is to provide an improved key hole light wherein the entire device can be mounted without removing or adjusting the lock or door knob. Another object of the present invention is to provide an improved key hole light wherein the lighting element requires very little electricity thereby requiring small batteries which will last for many months. Another object of the present invention is to provide an improved key hole light wherein the conductive switch surface is flexible so that it may be adhered to a contoured surface such as the steering column of a vehicle in the vicinity of the ignition switch.

To accomplish these ends the proposed key hole light is made of an electrolumiescant panel which is die cut in the shape of a doughnut with an integral tail terminating in a pair of flexible wires which lead to a flexible conductive panel which causes the electrolumenescent panel to light when touched by a user. An additional pair of wires emanate from the conductive switch panel and terminate in an electronic circuit and associated power supply which are encased in a plastic enclosure and mounted in close proximity to the conductive switch.

Touching the conductive switch panel causes the light to turn on and remain on for approximately 10 seconds and then automatically turn off thereby conserving battery life. Only the key hole is illuminated thereby not causing unnecessary lighting of an area. The bendable nature of the electroluminescent panel allows it to be secured to curved surfaces and around door knobs. The flexible nature of the conductive switch panel allows it to be mounted on a curved surface such as a steering wheel column. The following drawings will describe the present invention in detail.

DETAILED DESCRIPTION OF THE PREFERRED EMBODIMENT

Figure 1:
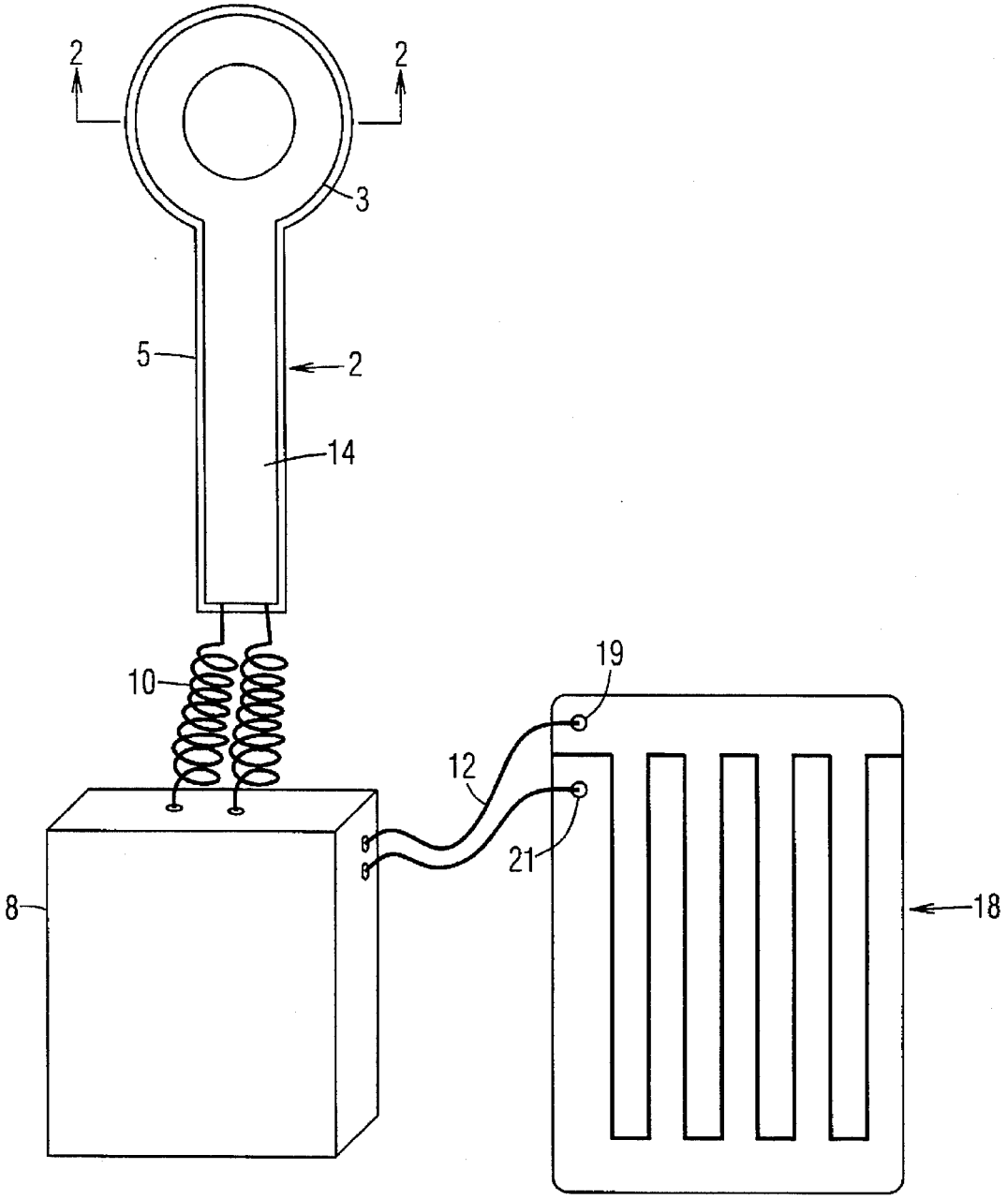
FIG. 1 is a front view of the present invention.

Referring now to FIG. 1 shows the three main elements of the improved key hole light. These are the electroluminescent light panel assembly 2, the electronic module 8 and the conductive touch switch 18. The light panel assembly 2 is connected to electronic module 8 by a pair of extendible coated wires 10. Switch panel 18 is connected to electronic module 8 by a pair of coated wires.

Figure 2:
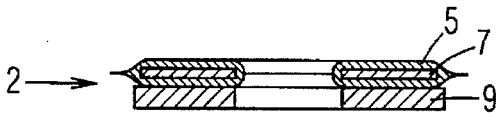
FIG. 2 is a section view of the electroluminescent display of the present invention.

FIG. 2 shows a section view of light display assembly 2. The electroluminescent light panel 7 is covered top and bottom by a dear laminated plastic 5 such as vinyl for weather proofing purposes. Double sided adhesive tape 9 holds the light display assembly 2 to a mounting surface such as a door lock.

Figure 3:
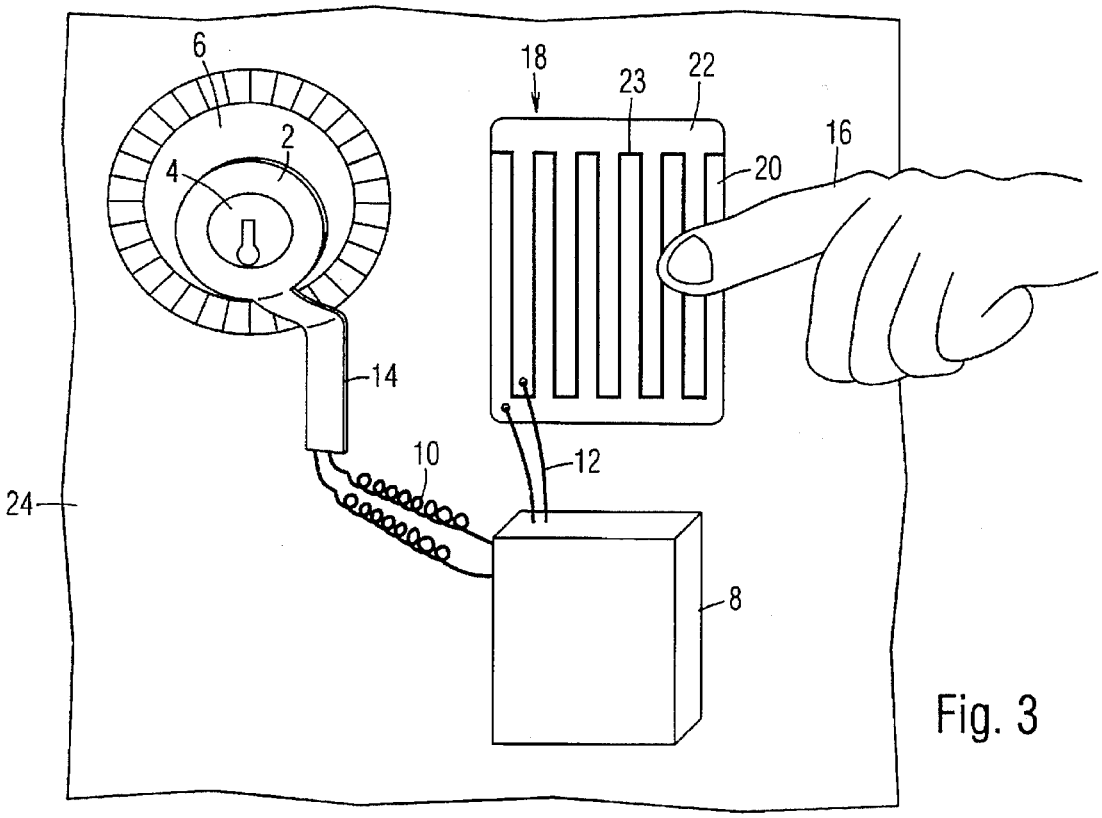
FIG. 3 is a perspective view of the present invention mounted on a door and cylinder lock.

FIG. 3 shows the present invention mounted on a door. Light assembly 2 is adhered around the key hole portion 4 of dead bolt lock 6. The flexible nature of the light assembly 2 allows the assembly 2 to conform to the side walls of the lock assembly 6. Electronic module 8 and conductive switch panel 18 each have double sided tape panels which adhere them in close proximity to the light display 2. Conductive switch 18 is composed of an undulating copper or other metallic pattern 22,20. a small non conductive gap 23 separates patterns 20 and 22. When a users hand 16 touches any portion of conductive switch panel 18 it acts as a conductor which completes the circuit between pattern 20 and pattern 22 thereby causing light display 2 to light up thereby illuminating the area immediately around the key hole 4. Electronic module 8 contains a timer circuit which automatically turns of light display 2 after approximately 10 seconds.

Figure 4:
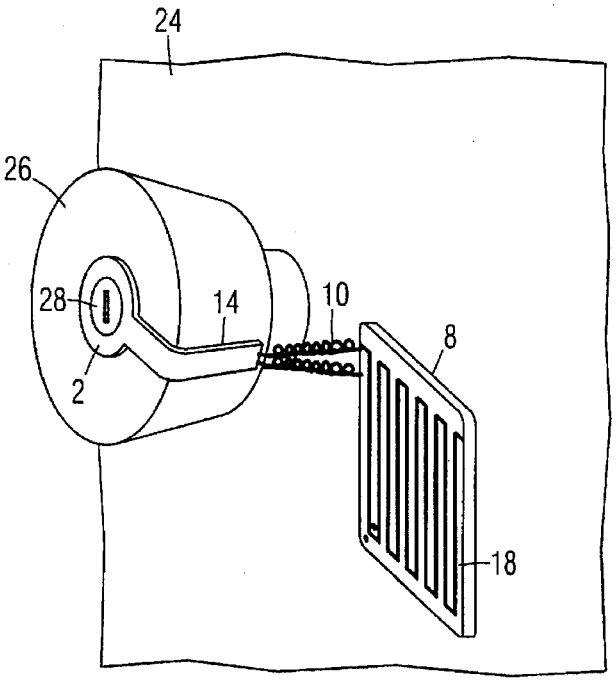
FIG. 4 is a perspective view of the present invention mounted on a door knob lock and door.

FIG. 4 shows the light display 2 mounted to a door knob which has a key hole assembly at its center 28. The flexible nature of the electroluminescent display 2 allows it to bend around and adhere to the side of the door knob 14 thereby allowing a user to grasp the door knob without interference. Extendible wires 10 allow the door knob to turn without disturbing the light display 2 or the switch panel 18 and electronic module 8 which in this view are mounted one on top of the other. The module 8 and attached Shiite panel 18 are mounted on a door 24 in close proximity to door knob 26.

Figure 5:
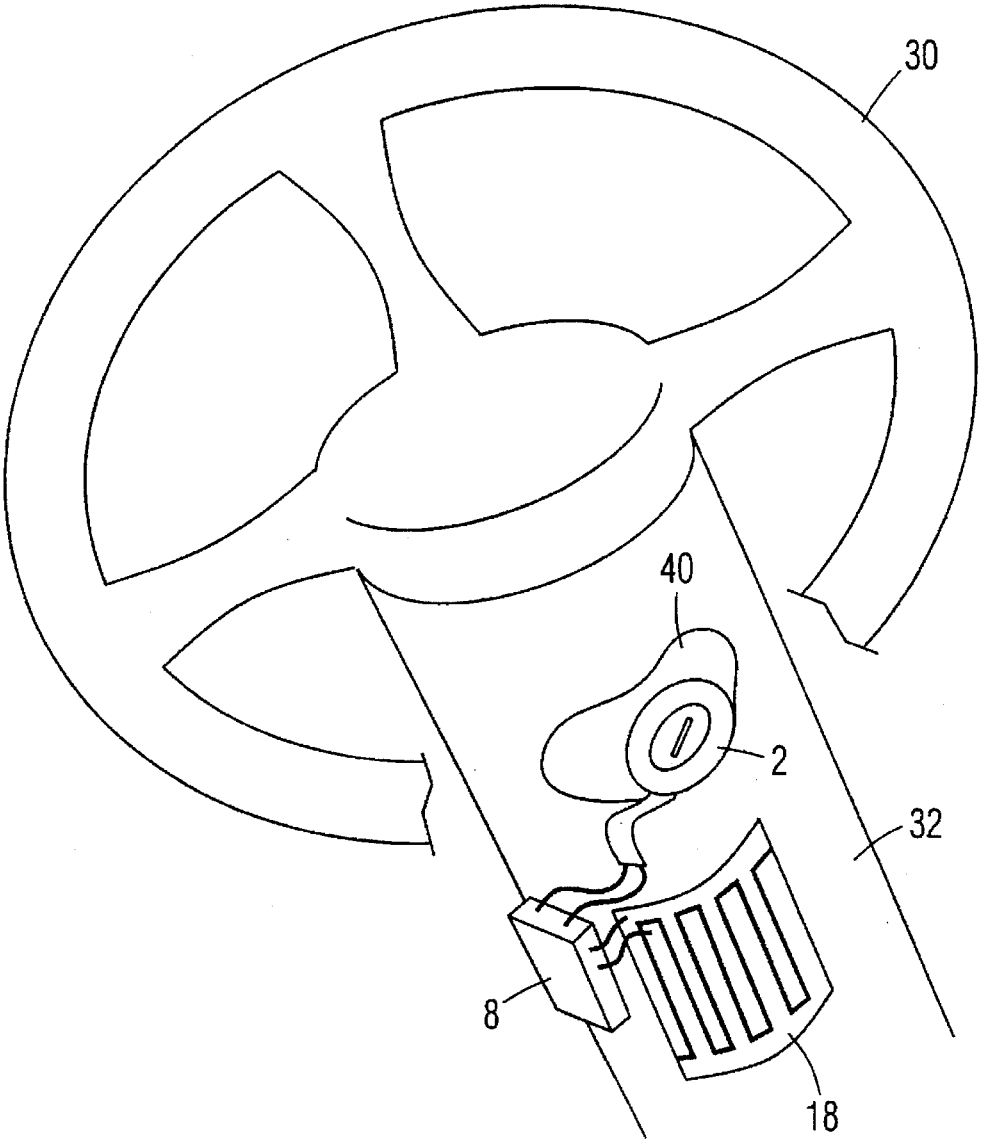
FIG. 5 is a perspective view of the present invention mounted on a steering wheel column of a vehicle.

FIG. 5 shows the present invention mounted on the ignition switch 40 and steering column 32 of a vehicle. Since light display 2 is flexible, it can adhere to the contours of the ignition switch 40. Switch panel 18 is also flexible because the copper pattern is only a few thousands of an inch thick and is mated to a flexible plastic substrate such as nomex. The switch panel 18 can therefore be adhered to the curved surface of steering wheel column 32 in close proximity to ignition switch 40. In this way the driver of a vehicle can touch anywhere on the switch panel 18 and have light panel 2 illuminate the key hole at the center of the ignition switch 40.

Figure 6:
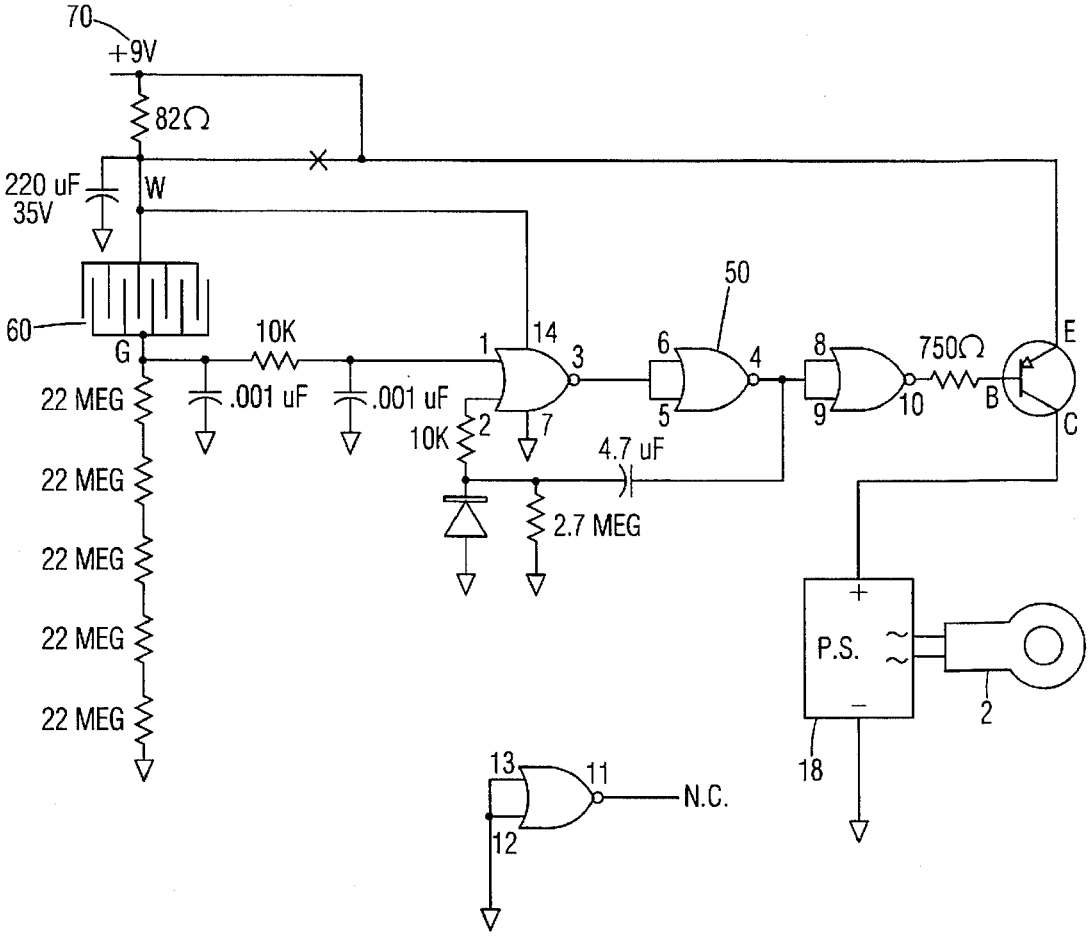
FIG. 6 is a schematic diagram of the electronic circuit of the present invention.

FIG. 6 shows a schematic diagram of the present invention. The schematic includes light assembly 2, conductive switch 18, timer circuit 50, high voltage transformer 60 and power supply 70. Because the electroluminescent display requires a minuscule amount of amperage and because the light display 2 is only on periodically for ten seconds at a time, the power supply battery 70 can last many months before needing replacement.

Although the above description represents the preferred embodiment of the present invention, the invention may take other forms which would be obvious to one versed in the state of the art. These include modifying the shape of the light display 2, modifying the pattern on switch panel 18 and incorporating the present invention into a lock or doorknob assembly.

Therefore I claim:

1. An improved key hole light comprised of three major elements, these being an electroluminescent light display, an electronic module which powers and controls said display and a conductive switch panel which when touched by a users finger causes said display to light for a period of approximately 10 seconds;

said light display being comprised of a flat, flexible, electroluminescant material, said material being die cut into a doughnut shape whose outside diameter is approximately one inch and whose inside diameter is approximately one half of one inch and whose tail is approximately 2 inches long and one quarter of an inch wide and whose underside is coated with double sided adhesive material;

said electronic module being comprised of an outer housing, a power supply, a high voltage transformer and a timer circuit;

said conductive switch being comprised of a thin, flat, undulating metallic pattern attached to a flexible plastic substrate, said substrate having double sided adhesive attached to its underside.

2. An improved key hole light as claimed in claim 1 wherein said electroluminescent display is covered top and bottom with a thin, clear plastic membrane.

3. An improved key hole light as claimed in claim 1 wherein said light display is connected to said electronic module by a pair of extendible coated wires.

* * * * *